US005637000A

United States Patent [19]

Osterbrock et al.

[11] Patent Number: 5,637,000

[45] Date of Patent: Jun. 10, 1997

[54] ELECTRICAL WIRING DEVICE WITH GROUND STRAP SHORTING PROTECTION

[75] Inventors: James A. Osterbrock, Central Square; Michael R. Bryndzia, Baldwinsville, both of N.Y.; Jean Claude Marcou, Limoges, France

[73] Assignee: Pass & Seymour, Inc., Syracuse, N.Y.

[21] Appl. No.: 594,138

[22] Filed: Jan. 31, 1996

[51] Int. Cl.[6] ..... H01R 13/652

[52] U.S. Cl. ..... 439/107; 439/934

[58] Field of Search ..... 439/107, 539, 439/934, 933, 934.1

[56] References Cited

U.S. PATENT DOCUMENTS 3,728,468 4/1973 Grauer ..... 439/107

5,145,404 9/1992 Beattie et al. ..... 439/934.1

*Primary Examiner*—Gary F. Paumen

*Attorney, Agent, or Firm*—Bond, Schoeneck & King

[57] ABSTRACT

An electrical wiring device, disclosed in the form of a duplex receptacle having the usual cover, body, terminals and mounting strap of the type extending longitudinally of the body rear surface and along the end surfaces. Two pairs of ribs are formed integrally with the body and extend in parallel relation longitudinally of the body rear surface with the strap lying between the two pairs of ribs. The purpose and effect of the ribs is to form a physical barrier of dielectric material and to lengthen the surface distance between the strap and portions of the hot and neutral wires terminated on the sides of the receptacle from which the insulation has been removed, thereby inhibiting electrical contact or arcing between the bare wires and the strap.

14 Claims, 2 Drawing Sheets

ELECTRICAL WIRING DEVICE WITH GROUND STRAP SHORTING PROTECTION

BACKGROUND OF THE INVENTION

The present invention relates to electrical wiring device constructions, and more particularly to a wiring device having a plastic body with wiring terminals on both sides, a metal grounding strap extending across its rear surface, and means for inhibiting electrical contact or arcing between the strap and bare wires connected to the terminals.

Some of the most common forms of wiring devices used in domestic and commercial wiring applications comprise molded plastic body portions with exposed wire terminations on both sides and a mounting/grounding strap extending across the rear surface. Such devices are connected to a power source by insulated wires from which the insulation is stripped at the end portions which are connected to terminals on the device. Although installers are instructed to limit the length of wire from which insulation is removed, and many devices have integrally incorporated stripping length gauges, it is not unusual for wires to be overstripped, sometimes to a large extent. This may result in hazardous conditions since it creates the possibility of an electrical short or arcing between the bare, energized wire and the exposed ground strap.

It is a principal object of the present invention to provide an electrical wiring device having novel and improved means for preventing unwanted electrical communication between an exposed mounting/grounding strap on the device and uninsulated portions of wires connected thereto.

Another object is to provide a wiring device for mounting behind a wall opening and having a molded plastic body portion with integral means for reducing the possibility of shorting or arcing between exposed portions of wires connected to the device and the device grounding strap.

Other objects will in part be obvious and in part appear hereinafter.

SUMMARY OF THE INVENTION

The wiring device of the invention is disclosed in the context of a duplex receptacle for mounting in a junction box supported behind a wall opening. The receptacle includes the usual molded plastic base or back body and cover portions cooperatively forming an enclosed housing containing the terminals having female contacts for receiving plug blades inserted through apertures in the cover. A grounding strap extends across the rear and end surfaces of the body with ears extending outwardly from each end for mounting the device in a standard junction box. Screw terminations are provided for connection of the hot and neutral wires on the line and load sides of the device to exposed portions of the terminals on each side of the body.

The rear side of the body includes first and second pairs of parallel ribs on opposite sides of the surface area with which the ground strap is superposed. The opposing sides of the inner ribs of each pair are spaced from one another by a distance substantially equal to the width of the strap portion which is placed therebetween. The ribs are of equal height, i.e., the parallel, free edges of the ribs lie in a common plane, spaced from and parallel to the major, external surfaces of both the body and the strap. The ribs of each pair are spaced from one another by a relatively short distance, forming an elongated channel between the two ribs of each pair.

The ribs extend longitudinally of the device at least in the areas between the screw terminations on the sides and the inwardly adjacent portions of the strap, and preferably beyond such areas. Bare portions of the wires connected to the screw terminations from which insulation has been removed to an excess length are subject to contact with the strap, or to being in close enough proximity thereto that arcing will occur, particularly when the device and wires are pushed into a junction box. The ribs on the back of the body form a barrier between the wires and the strap, as well as lengthening the surface area over which an arc must travel between the wires and strap.

The foregoing and other features and advantages of the invention will be more readily understood and fully appreciated from the following detailed description, taken in conjunction with the accompanying drawings.

DETAILED DESCRIPTION

Figure 1:
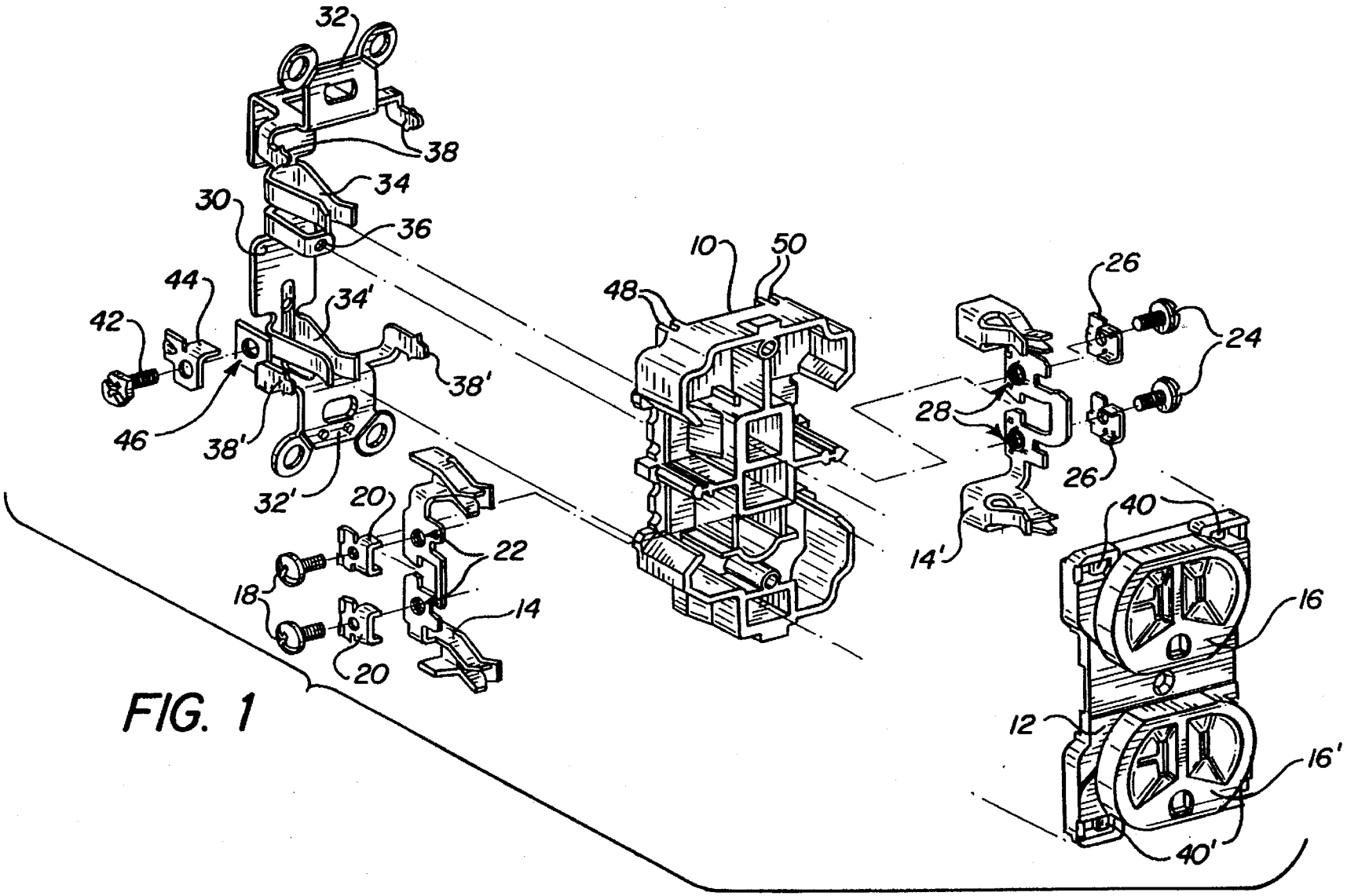
FIG. 1 is an exploded perspective view of a wiring device in the form of a duplex receptacle embodying the invention.

Referring now to the drawings, in FIG. 1 are seen the elements of an electrical wiring device in the form of a duplex wall receptacle including molded plastic body and cover portions 10 and 12, respectively. Metal terminals 14, 14' each have a pair of female contacts for receiving the blades of electrical plugs inserted through apertures in plug-receiving portions 16, 16' of cover 12. Terminals 14, 14' are configured for placement in compartments defined by wall means within body 10 with portions of the terminals exposed at the sides. Screws 18 pass loosely through openings in pressure plates 20 and are received in openings 22 in the exposed portion of terminal 14. Likewise, threaded screws 24 pass through openings in pressure plates 26 and are received in threaded openings 28 in terminal 14'.

Strap 30 includes ears 32, 32' for mounting the device in a junction box, as well as contacts 34, 34' for receiving the grounding prongs of plugs inserted into the receptacle. In the disclosed embodiment, strap 30 also includes bent-over portion 36 having a threaded opening for receiving a screw to fasten a wall plate (not shown) to the device, and first and second pairs 38, 38', respectively, of tabs which pass through areas 40 and 40' in cover 10 and are fixedly engaged to maintain the body, cover and strap in mutually assembled relation. Screw 42 passes through pressure plate 44 and is received in threaded opening 46 for attaching a grounding wire to strap 30.

Figure 2:
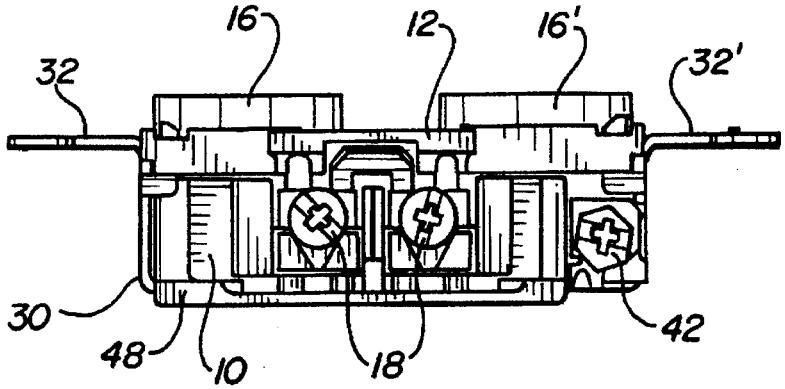
FIG. 2 is a side elevational view of the receptacle of FIG. 1 in fully assembled condition.
Figure 3:
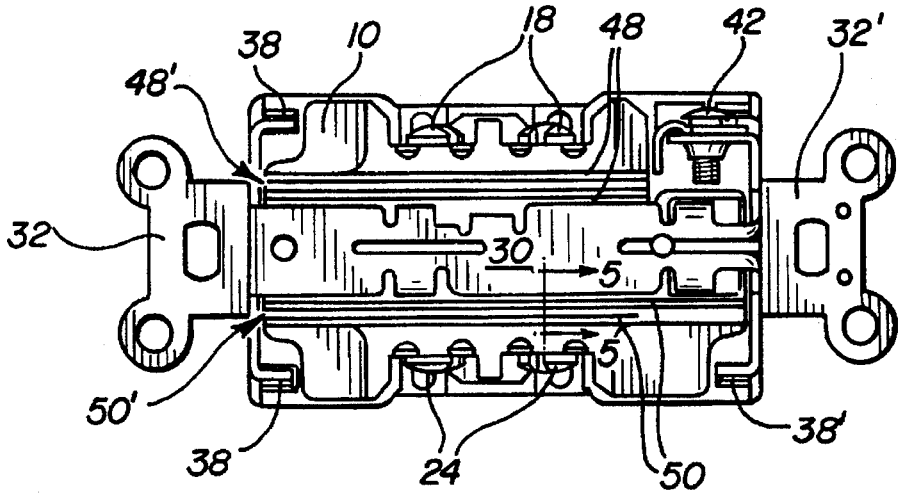
FIG. 3 is a rear or bottom plan view of the assembled receptacle.
Figure 4:
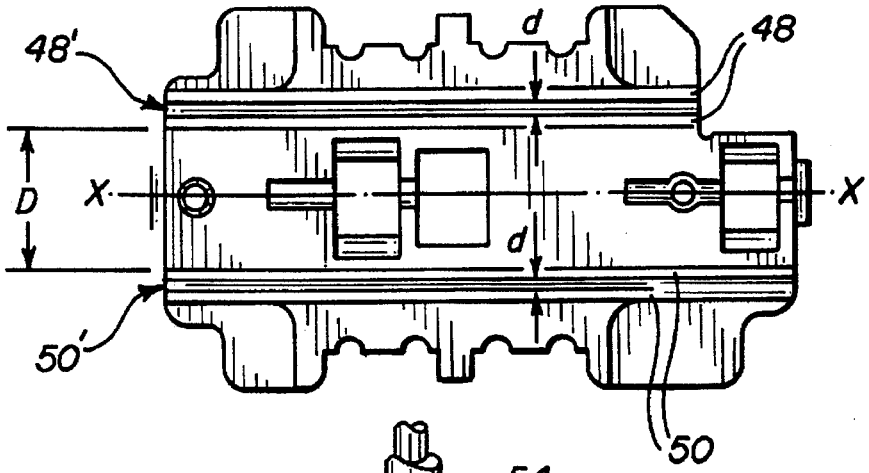
FIG. 4 is a bottom plan view of the body portion of the receptacle.

The receptacle is shown in FIG. 2 as seen from one side, the appearance being substantially the same from the other side, except for the absence of grounding screw 42, and in FIG. 3 as seen from the rear or bottom side. The rear side of body 10 is shown in FIG. 4 wherein it will be noted that first and second pairs of ribs 48 and 50, respectively, extend parallel to and on opposite sides of central, longitudinal axis X—X of body 10. Ribs 48 are spaced from one another by a distance d about equal to the thickness of each rib, forming channel 48' therebetween. Ribs 50 are similarly spaced from one another, forming channel 50'. The opposing, inwardly facing surfaces of the inner ribs of each pair are spaced by a distance D which is slightly greater than the widths of the medial portion of strap 30 which, as seen in FIG. 3, lies between the two pairs of ribs in the fully assembled receptacle.

Before hot and neutral wires are connected to terminals 14, 14' by means of the side screw terminations, the insulation is removed from an end portion of each wire. The bare or stripped portion is inserted between the appropriate one of pressure plates 20, 26 and the corresponding terminal 14, 14'. Each screw is tightened to ensure good electrical contact between the wires and terminals, and the receptacle and attached wires are placed in and connected to a junction box, usually mounted behind a wall opening.

It is necessary, of course, to avoid bringing bare portions of the hot and neutral wires into physical contact with strap 30, or into such close proximity that arcing between the wires and strap may occur. Although instructions packed with and/or appearing upon most wiring devices indicate that the ends of hot and neutral wires should not be stripped of their insulation by more than a specified length, it is not uncommon for installers, particularly those with no training and little practical experience in electrical wiring, to remove an excess length of insulation. This, of course, increases the possibility of shorting or arcing between the bare wires and the strap, particularly when the wires are pushed into a junction box together with the receptacle.

Figure 5:
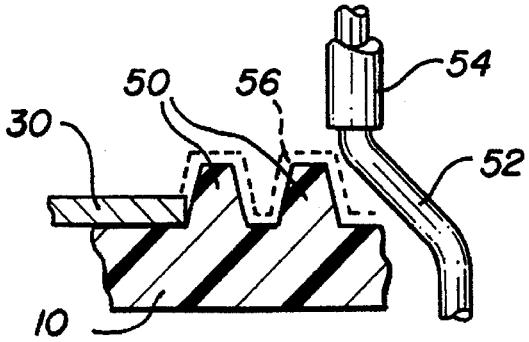
FIG. 5 is an enlarged, fragmentary, elevational view in section on the line 5—5 of FIG. 3.

An enlarged fragment of the receptacle is shown in section in FIG. 5, together with a wire which is connected at its bare end to terminal 14. Stripped (bare) and insulated portions of the wire are indicated by reference numerals 52 and 54, respectively. Since an arc between bare wire portion 52 and grounded strap 30 would normally travel across a surface of dielectric body member 10, it will be seen that the presence, positioning and spacing of ribs 50 significantly lengthens the path, represented by dotted line 56, over which an arc must travel between the wire and strap. Thus, the ribs form a physical barrier on each side, as well as lengthening the arc gap, thereby reducing the hazards associated with faulty wiring.

What is claimed is:

1. An electrical wiring device for connection to end portions of hot and neutral wires from which insulation has been removed, said device comprising:

a) a body portion of dielectric material;

b) at least one electrically conducting terminal to which at least one of said wire end portions is connected adjacent a first, external surface area on said body;

c) an electrically conducting mounting strap connected to ground potential and extending along and superposed with a second, exterior surface area of said body spaced from said first area; and d) a pair of elongated ribs formed integrally with said body and extending outwardly therefrom to respective, spaced edges, and longitudinally thereof throughout an elongated area between said first and second surface areas.

2. The device of claim 1 wherein said body portion has a front, a rear, two opposite sides, and two opposite end surfaces, said first surface area lying on one of said sides and said second surface area lying on said rear of said body portion.

3. The device of claim 2 and further including another electrically conducting terminal to which another of said wire end portions is connected adjacent a third, external surface area on the other of said sides of said body, said strap is further superposed with a fourth, external surface area on said rear of said body, and a second pair of elongated ribs formed integrally with said body and extending outwardly therefrom to respective, spaced edges, and longitudinally thereof throughout a second, elongated area between said third and fourth surface areas.

4. The device of claim 3 wherein said first pair of ribs are spaced from one another by a distance substantially equal to the spacing between said second pair of ribs.

5. The device of claim 4 wherein said edges of all of said ribs lie in a common plane.

6. The device of claim 5 wherein the exterior surface of the portion of said strap lying between said pairs of ribs lies in a plane between said common plane and said body rear surface.

7. The device of claim 4 wherein all of said ribs are of substantially equal thickness and said distance is substantially equal to said thickness.

8. The device of claim 4 wherein all of said ribs extend longitudinally of said body in parallel relation to one another, said first and second pairs lying on opposite sides of and parallel to the longitudinal centerline of said body extending between said opposite ends on said rear of said body.

9. The device of claim 8 wherein the opposing surfaces of the innermost ribs of said pairs are spaced by a distance slightly less than the width of the portion of said strap lying between said pairs of ribs.

10. In a duplex receptacle having a cover with apertures for receiving the blades of two electrical plugs, a dielectric body portion cooperatively with said cover defining an enclosed housing having front, rear, opposite side and opposite end walls, a pair of electrically conducting terminals having female contacts positioned within said housing to receive said blades and exposed portions adjacent predetermined portions of said opposite side walls for attachment thereto of end portions of hot and neutral wires of an electrical circuit wherein said receptacle is connected, and an electrically conducting strap connected to ground potential and extending longitudinally of said housing between said opposite end walls and laterally over a central portion of a first, exterior, planar surface portion of said rear wall, said strap having a second, exterior, planar surface portion substantially parallel to said first surface portion, the improvement comprising:

a) a first pair of ribs formed integrally with said body and extending outwardly from said rear wall exterior surface and longitudinally of said housing substantially parallel to one another with opposing surfaces laterally spaced from one another by a first distance, said first pair of ribs being positioned between said predetermined portions of one of said side walls and said strap to form a dielectric physical barrier and to lengthen the surface distance therebetween; and b) a second pair of ribs formed integrally with said body and extending outwardly from said rear wall exterior surface and longitudinally of said housing substantially parallel to one another with opposing surfaces laterally spaced from one another by a second distance, said second pair of ribs being positioned between said predetermined portions of the other of said side walls and said strap to form a dielectric physical barrier and to lengthen the surface distance therebetween.

11. The improvement of claim 10 wherein all of said ribs are of substantially equal thickness.

12. The improvement of claim 11 wherein the respective ribs of each of said pairs are spaced from one another by a distance substantially equal to said thickness.

13. The improvement of claim 12 wherein the opposing surfaces of the innermost ribs of said pairs are spaced by a distance slightly less than the width of the portion of said strap lying between said pairs of ribs.

14. The improvement of claim 13 wherein said ribs each have a free edge all of said free edges lying in a common plane, and the portion of said strap lying between said pairs of ribs has a substantially planar, exterior surface lying in a plane between said common plane and said body rear surface.

* * * * *